United States Patent [19]

DiMatteo et al.

[11] Patent Number: 4,837,872

[45] Date of Patent: Jun. 13, 1989

[54] PATIENT TRANSFER ARRANGEMENT

[75] Inventors: Paul DiMatteo, Dix Hills; Robert Segnini, Stony Brook, both of N.Y.

[73] Assignee: Nova Technologies, Inc., Hauppauge, N.Y.

[21] Appl. No.: 90,376

[22] Filed: Aug. 28, 1987

Related U.S. Application Data

[63] Continuation-in-part of Ser. No. 731,533, May 7, 1985, Pat. No. 4,776,047.

[51] Int. Cl.[4] ..... A61G 7/00

[52] U.S. Cl. ..... 5/60; 5/81.13; 5/446; 128/33

[58] Field of Search ..... 5/60, 81.12, 81.13, 5/81.6, 446, 447, 453, 455, 488; 128/33, 70

[56] References Cited

U.S. PATENT DOCUMENTS

| | | | |
|---|---|---|---|
| 716,886 | 12/1902 | Goode | 5/81 B |
| 942,606 | 12/1909 | Wilson | 5/81 B |
| 2,536,707 | 1/1951 | Allyn | 5/81 B |
| 2,904,036 | 9/1959 | Thomas | 128/33 |
| 3,701,173 | 10/1972 | Whitney | 5/453 |
| 4,175,297 | 11/1979 | Robbins et al. | 5/453 X |
| 4,267,610 | 5/1981 | Blakeway et al. | 5/60 |
| 4,267,611 | 5/1981 | Aqulnick | 5/455 X |
| 4,347,633 | 9/1982 | Gammons et al. | 5/453 |

*Primary Examiner*—Alexander Grosz
*Assistant Examiner*—Michael F. Trettel
*Attorney, Agent, or Firm*—Max Fogiel

[57] ABSTRACT

A transfer system including a specially-equipped bed for transferring a patient from a reclining position on the bed to a seated position on a wheelchair or to a standing position on the floor.

11 Claims, 18 Drawing Sheets

PATIENT TRANSFER ARRANGEMENT

The present application is a continuation-in-part of the parent application Ser. No. 731,533 filed May 7, 1985 now U.S. Pat. No. 4,776,047.

BACKGROUND OF THE INVENTION

The process of transferring an invalid person from a hospital bed to a wheelchair, to a commode, or to a toilet, or assisting such a person in such a transfer, often involves more than one person, is labor-intensive and can be costly. The task frequently requires considerable strength and is occasionally a source of injury to the person, nurse, or attendant. These problems often are the major factors that cause a person to be hospitalized or moved to a nursing home, rather than being cared for at home. They also increase the cost of caring for persons in hospitals and nursing homes.

Accordingly, it is the primary object of the present invention to provide a transfer system including a transfer module in combination with a suitably equipped bed and wheelchair, whereby a person can be easily, safely, and comfortably transferred between a bed and a wheelchair with no effort on the part of the person, and requiring only minimal physical strength or skill from an attendant.

Another object of the present invention is to comfortably lift and rotate a seated person so as to move him backwards onto a bed, and to transport him fully onto the bed with a moving sheet.

It is another object of the present invention to provide means for transferring the person between a bed and a commode.

It is a further object of the present invention to provide means for moving a person from a reclining position on a bed to a standing position on the floor.

It is still another object to provide modifications to standard beds and wheelchairs whereby the modified beds and wheelchairs and some types of unmodified commode-shower chairs can be employed for patient transfer, according to the present invention.

It is another object of this invention to provide a transfer sheet with fasteners for attaching bed sheets on which a patient may lie comfortably and which can be conveniently changed.

A further object of this invention is to provide a method of preventing or reducing the likelihood of decubitus ulcers in a bedridden patient.

Additional objects and advantages of the present invention will become evident from the following description of specific embodiments when read in connection with the accompanying drawings.

It is to be understood that the term wheelchair as used in this present application includes commode.

Figure 8:
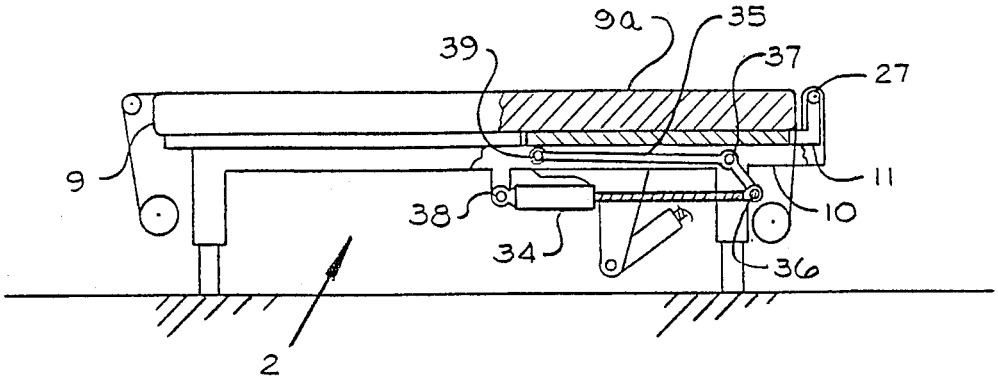
Figure 9:
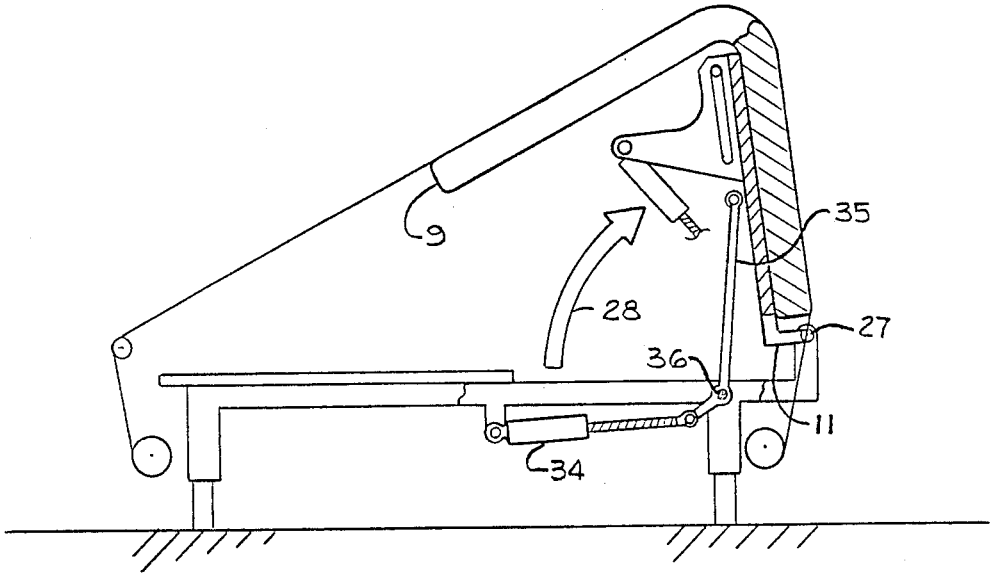
Figure 10:
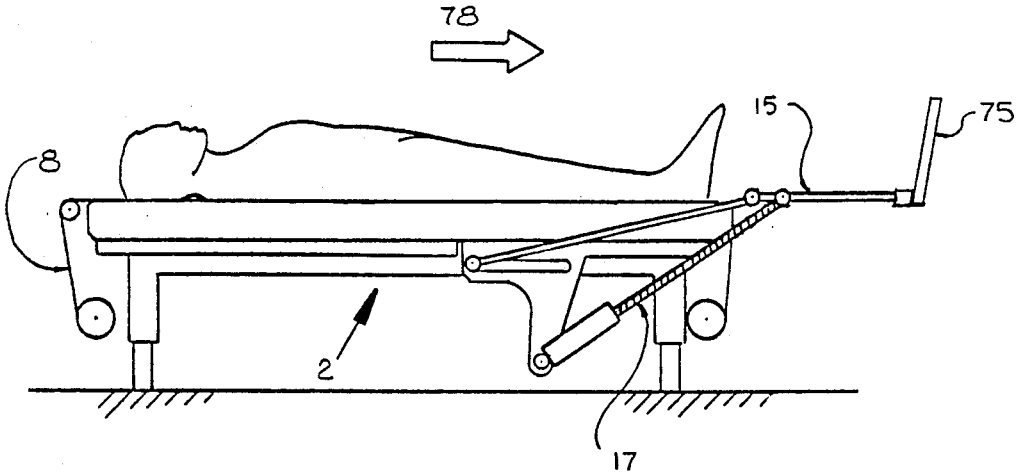
Figure 11:
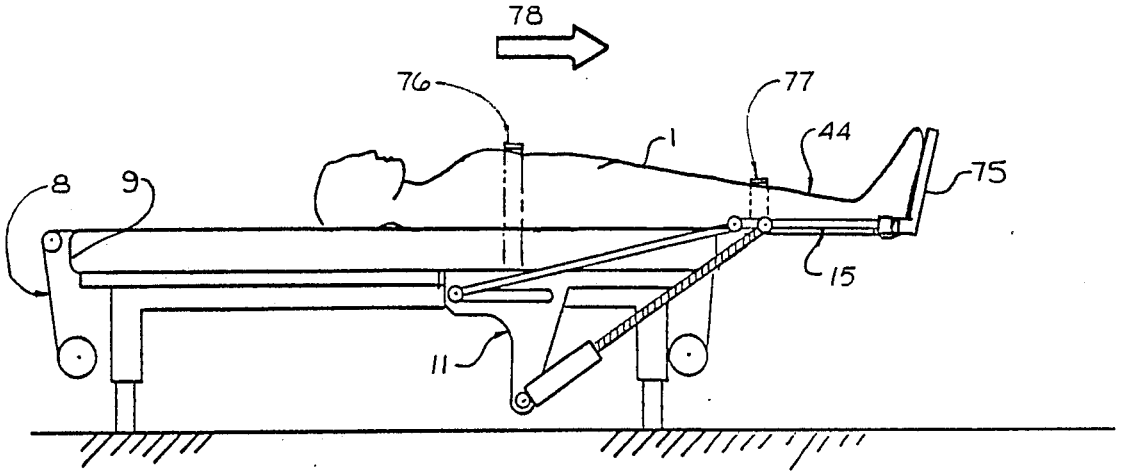
Figure 12:
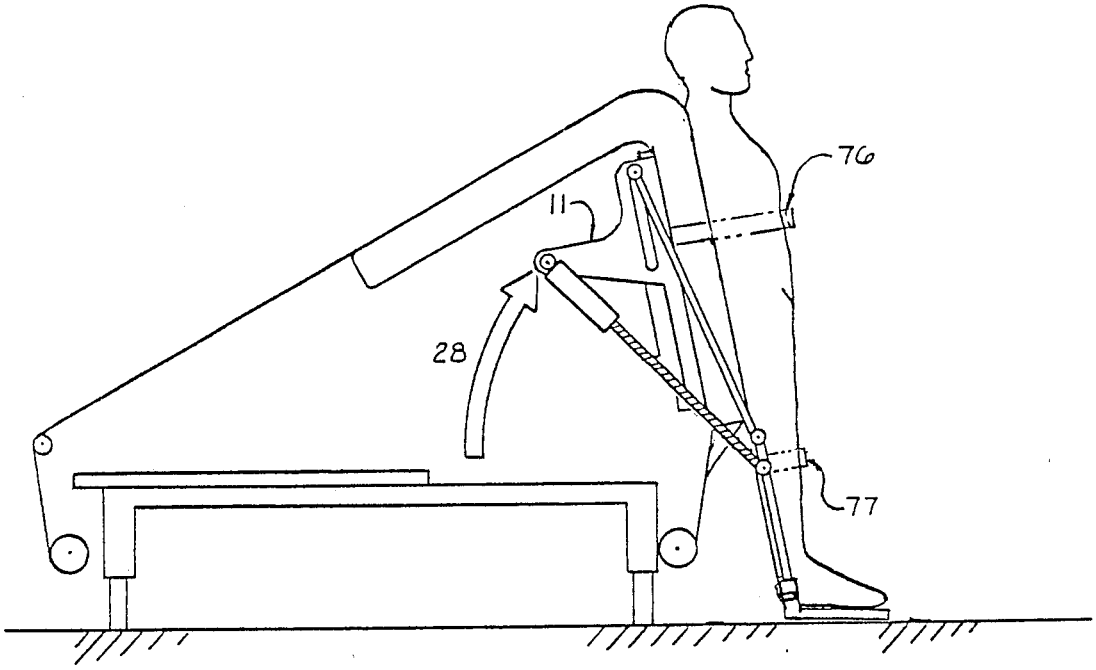
Figure 17:
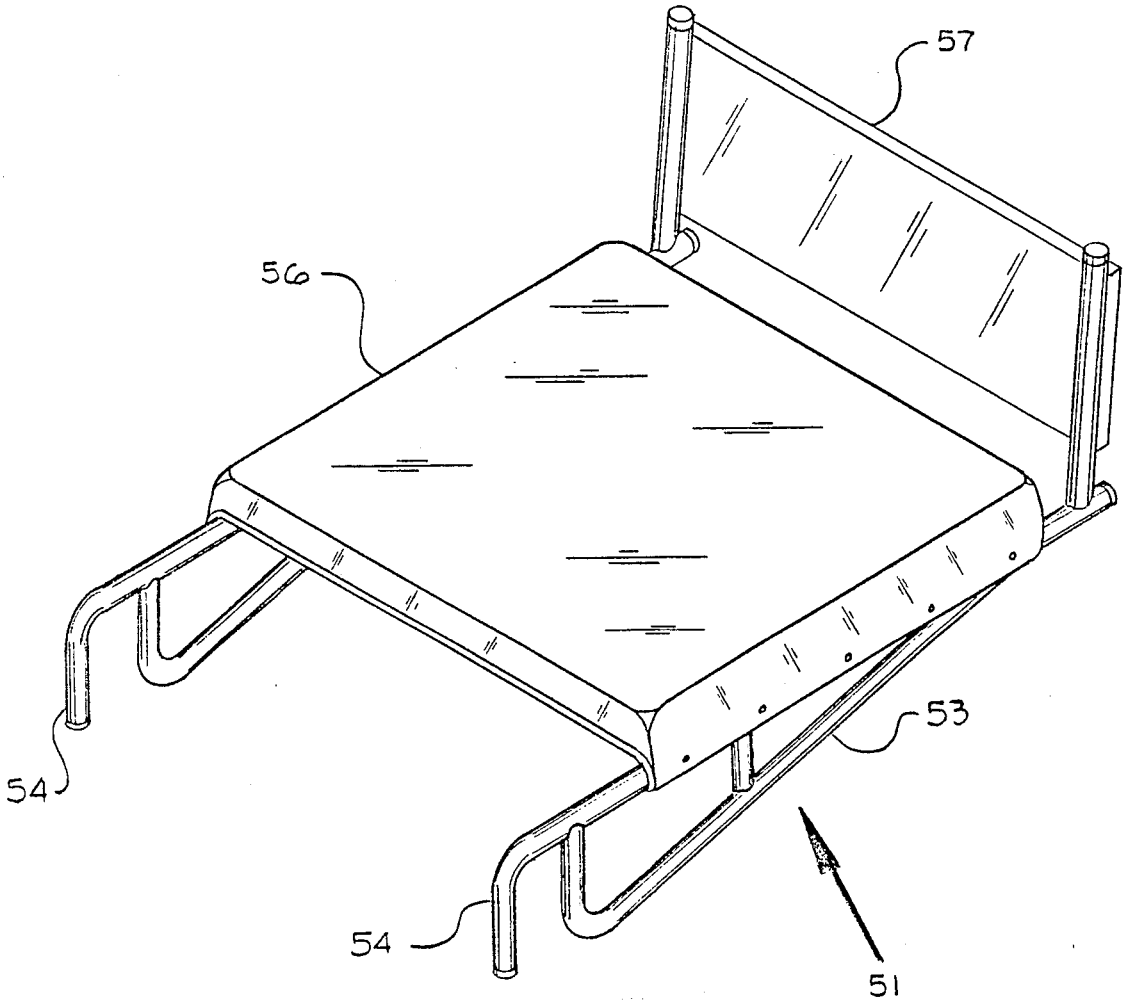
Figure 18:
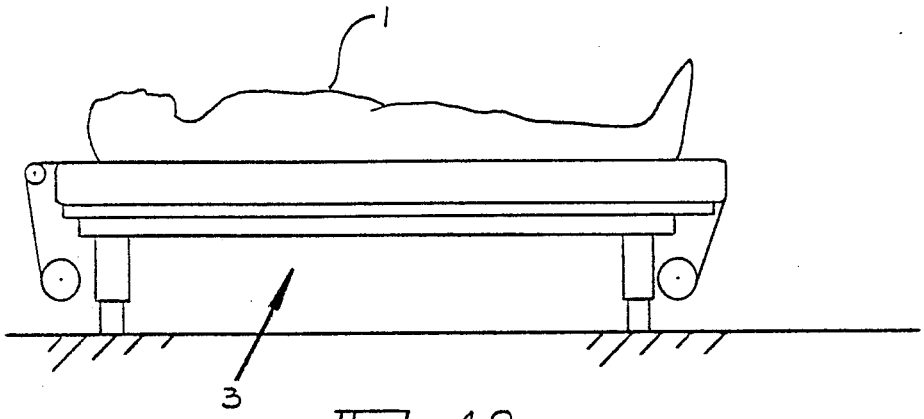
Figure 19:
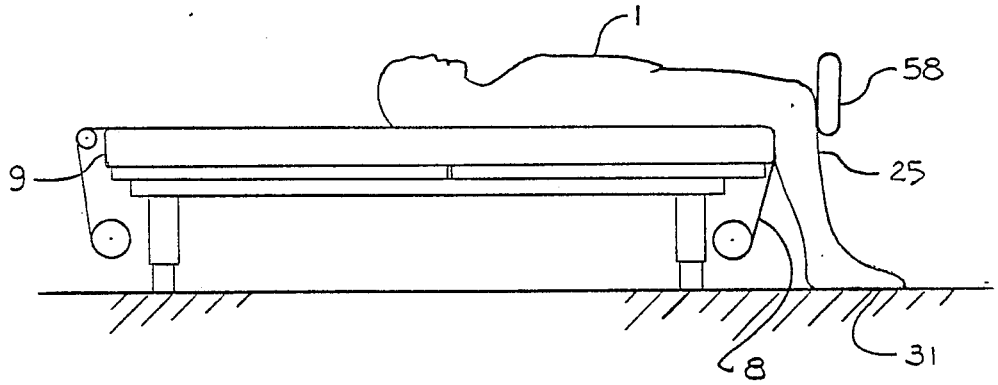
Figure 20:
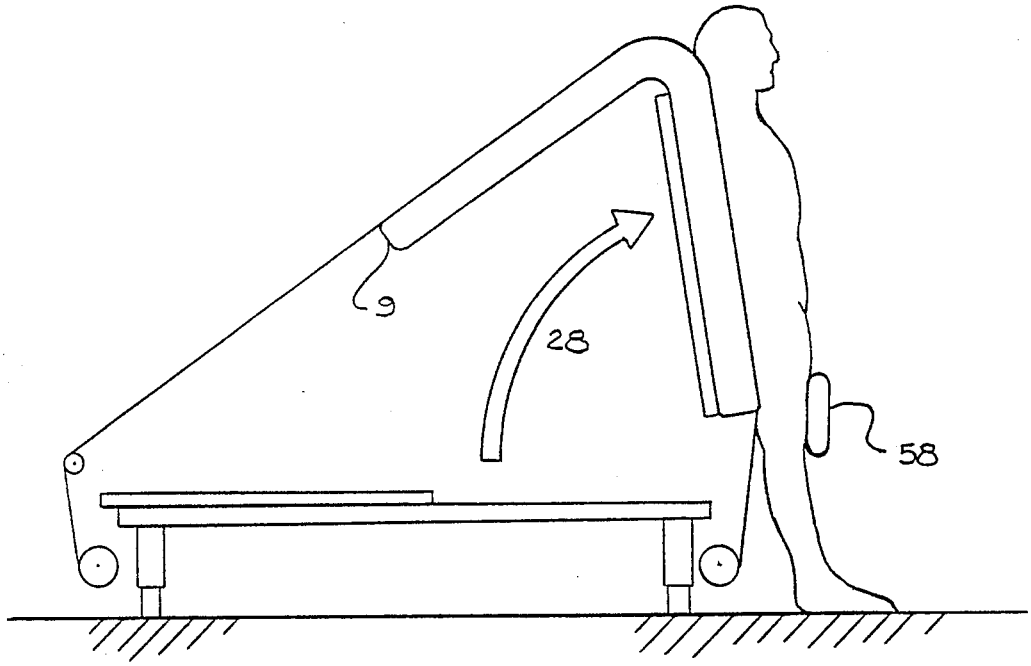
Figure 21:
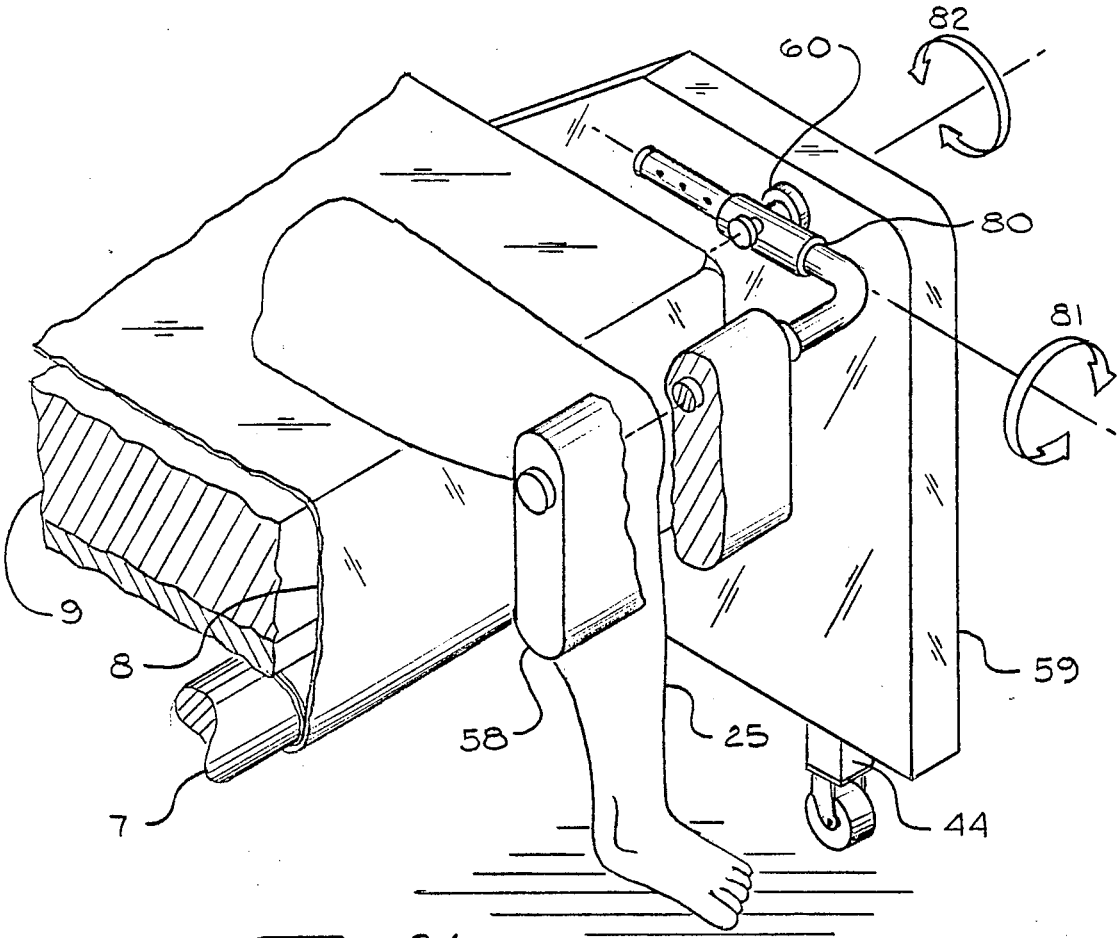
Figure 21A:
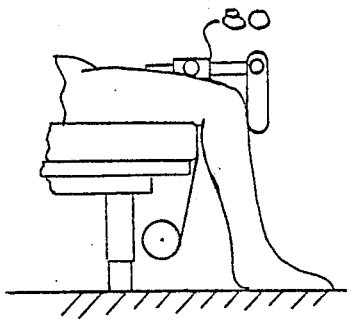
Figure 21B:
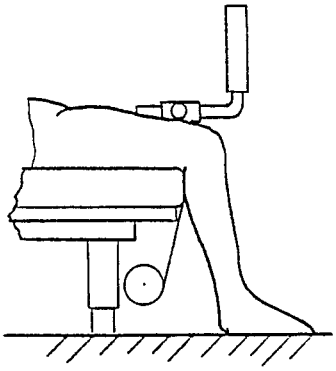
Figure 21C:
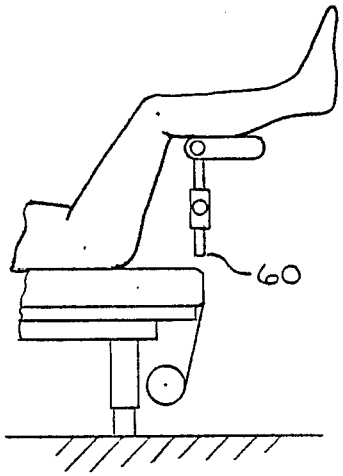
Figure 22:
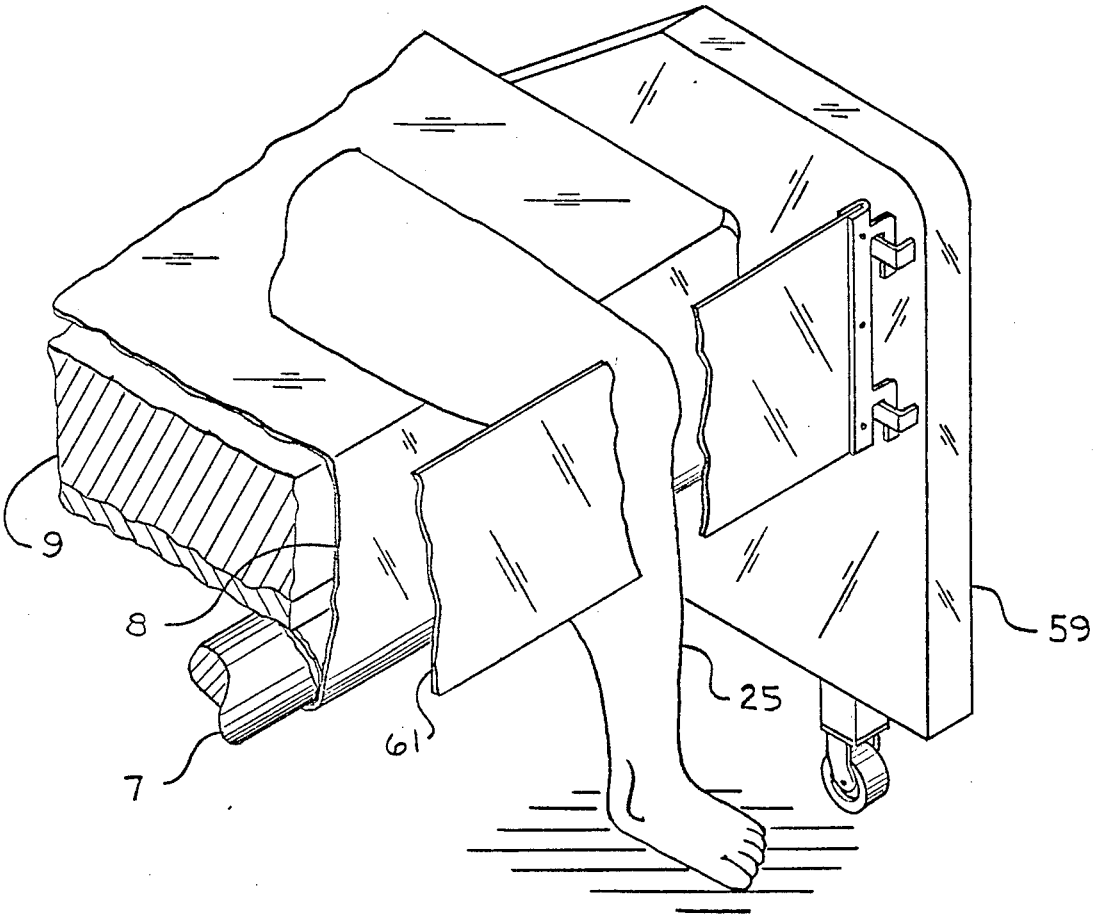
Figure 23:
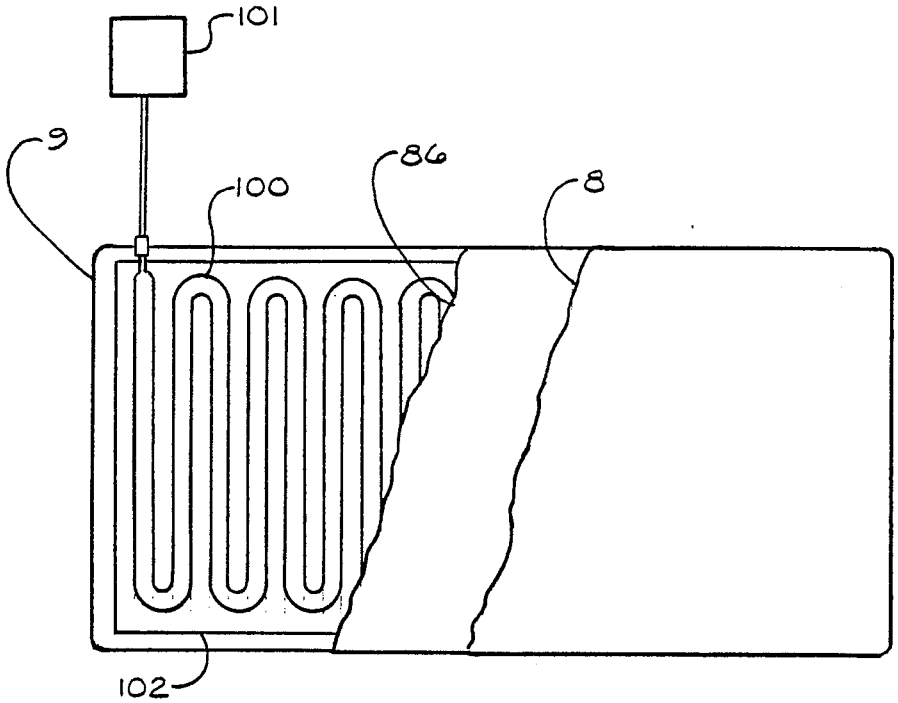
Figure 24:
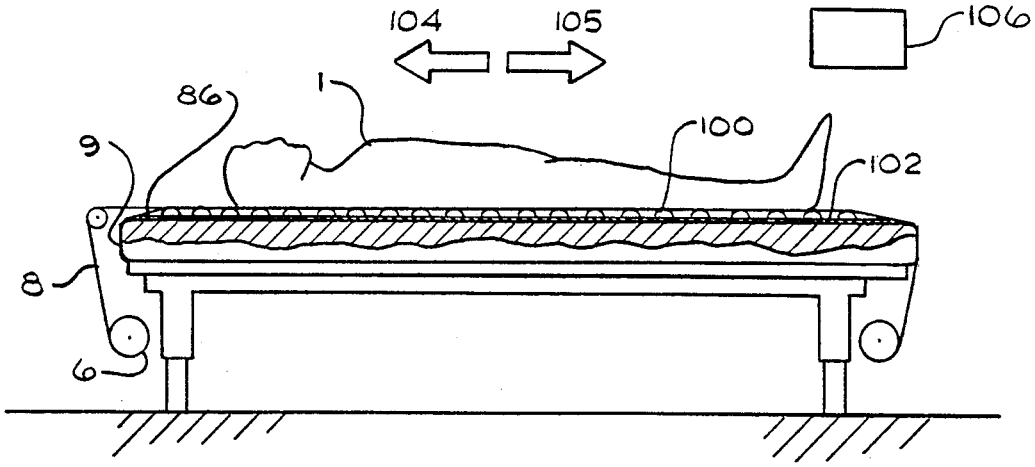
Figure 25:
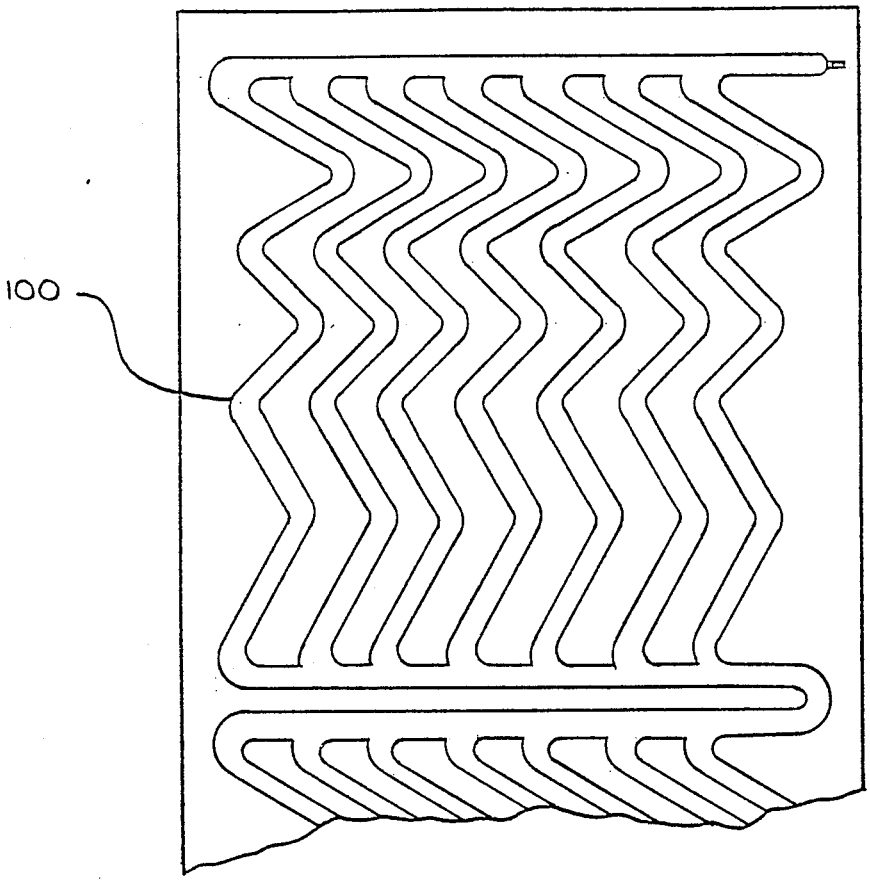
Figure 26:
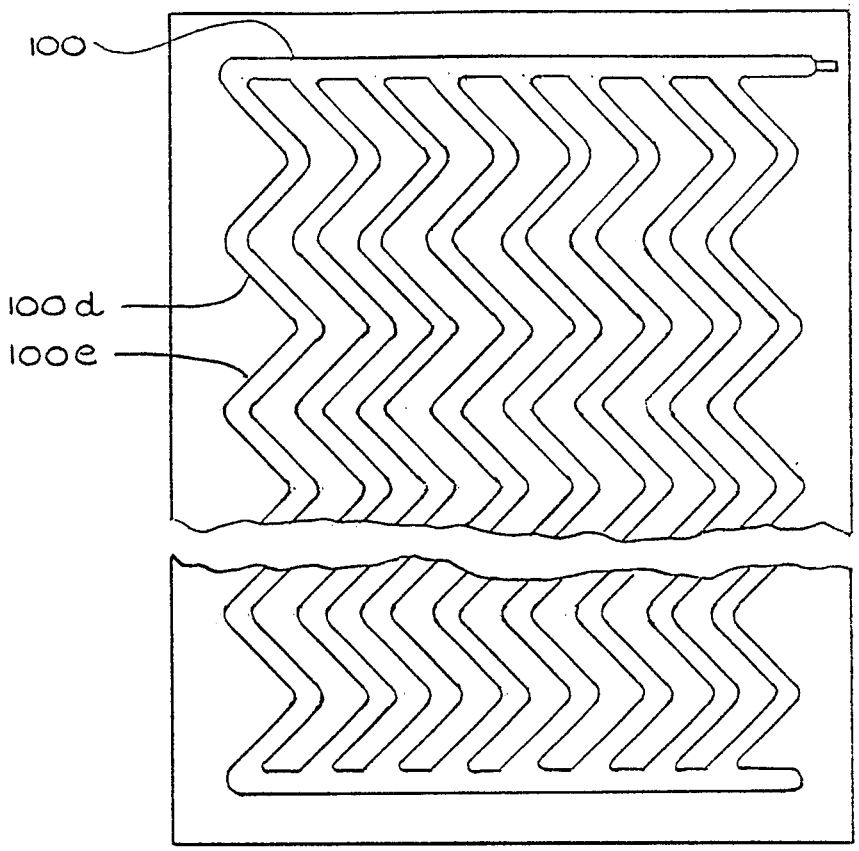
Figure 27:
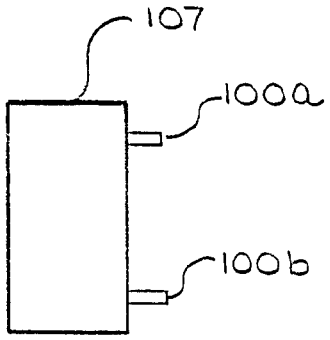

FIG. *7a* is a perspective view of a commode seat;

FIG. *7b* is a partial perspective view showing the construction of a mattress and sheets;

FIG. 8 is a partial cross-sectional side view showing the mattress lift in its lowest position;

FIG. 9 is a partial cross-sectional side view showing the mattress lift fully raised;

FIGS. 10, 11 and 12 are schematic sequential views showing a patient being transferred from a bed to a standing position on the floor;

FIGS. 13 through 16 are schematic sequential views showing an alternate method of transferring a patient from a bed to a standing position on the floor;

FIG. 17 is a perspective view of a foot and leg support;

FIGS. 18 through 20 are schematic sequential views showing another method of transferring a patient from a bed to a standing position on the floor;

FIG. 21 is a partial perspective view of a patient at the end of a bed with a movable leg support for a standing person;

FIGS. 21*a*, 21*b*, and 21*c* are partial schematic side views showing different positions of the movable leg support of FIG. 21;

FIG. 22 is a front view of the bed with a flexible leg brace for a standing person;

FIG. 23 is a schematic top view of a mattress including an arrangement for preventing decubitus ulcers;

FIG. 24 is a partial cross sectional side view of the arrangement in FIG. 23;

FIGS. 25 and 26 are partial schematic top views showing variations of the arrangement of FIG. 23; and FIG. 27 is a schematic drawing of another variation of the arrangement of FIG. 23.

DESCRIPTION OF THE PREFERRED EMBODIMENTS

FIGS. 1 through 6 illustrate schematically the principles and steps used to transport a patient 1 from a reclining position on a bed 2 to a seated position on a wheelchair 3.

Figure 1:
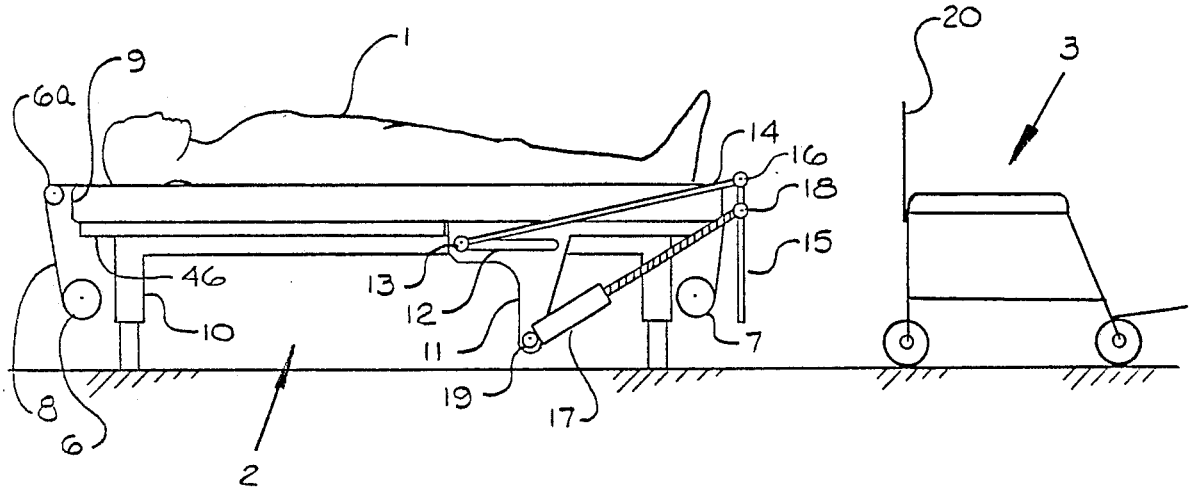
FIGS. 1 through 6 are schematic sequential views showing a patient being transferred from a bed to a wheelchair under the principles of the present invention.

FIG. 1 shows a patient 1 reclining on a bed 2 ready to be transferred to wheelchair 3.

The bed 2, as shown in FIG. 1, consists of a modified conventional health care bed with a main frame 10 and an articulated movable frame 46. An elevating device, not shown, but commonly included on hospital and many home health care beds, is used to raise or lower the mattress 9 to the proper height to perform the required operations. Attached to the main frame 10 is an arrangement for transporting a patient 1 from a position on the bed to and beyond the end of the bed. This transport arrangement contains a transport roller 6 and an optional idler roller 6*a* which are mounted to the bed frame at the head end of the bed as shown; alternatively, the transport roller 6 may be mounted alone on the articulated frame 46. A similar transport roller, 7 is mounted at the foot end of the bed. A specially designed transport sheet 8, approximately equal in width to the bed and significantly longer than the bed, is fastened to and partially rolled up on the transport roller 6 while the other end is fastened to and partially rolled up on the transport roller 7 at the foot end of the bed. Mechanical power sources such as electric motors with clutches, or hand cranks, are provided for driving the two transport rollers 6 and 7 to wind up the sheet on one roller while unwinding it from the other so as to move the sheet 8 over the surface of the mattress 9 and thereby transport patient 1 reclining thereon, across the surface of the mattress.

This particular arrangement of rollers is shown to help illustrate the principles applying to the present invention, but the invention is not limited to this configuration. Other arrangements for moving a sheet across a bed to transport a person over the bed can be used equally well.

The mattress 9 is supported under its head portion by the articulated frame 46 and under its leg portion by a mattress lift member 11. Slidably mounted in a slot 12 in the mattress lift member 11 on each side of the bed, is a sliding pivot 13 attached to a link 14 which is attached to a leg rest 15 through a pivot 16. The leg rest 15 is also attached to frame 11 through a pivot 18, an actuator 17, and a pivot 19. The actuator 17 is a linear actuator, which provides translational motion. Such actuators are widely used and are available commercially. The leg rest 15 is shown in its stowed position in FIG. 1.

In FIG. 1 the wheelchair 3 is shown in a position away from the bed 2 on which a person 1 is reclining. The wheelchair 3 has a back rest 20 which is removable so as to not interfere with the patient transfer. For example, a commercially-available commode-shower chair which has a removable back rest can be used.

Figure 2:
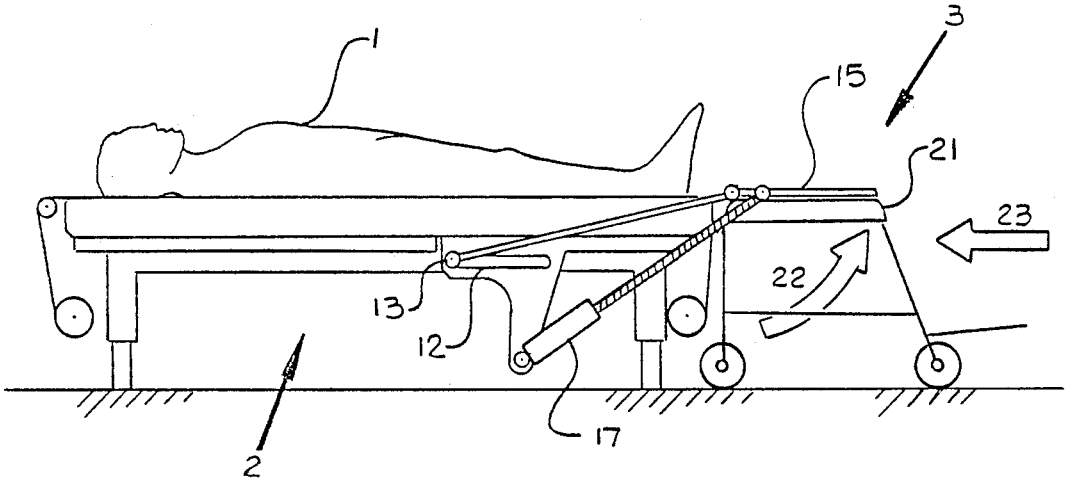

FIG. 2 shows the initial steps in transferring the patient 1 to the wheelchair 3. The actuator 17 is extended to lift the foot rest 15 to a horizontal position as indicated by the arrow 22. A spring, not shown for reasons of clarity, holds the sliding pivot 13 from moving forward in slot 12. The wheelchair back rest 20, shown in FIG. 1, is removed. The wheelchair 3 is then moved to the bed with its seat 21 under the leg rest 15, as shown by the arrow 23. The wheelchair 3 is then locked to the bed 2, or otherwise fixed in position.

Figure 3:
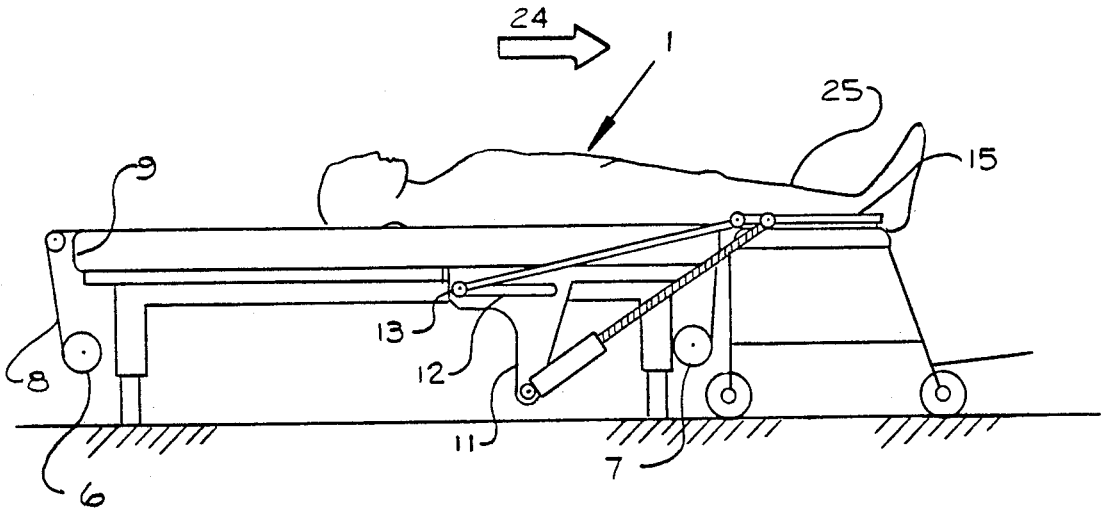

FIG. 3 shows the patient 1 being transported in the direction of arrow 24 so that his legs 25 are resting on the leg rest 15, by the action of the roller 7 and the sheet 8. The roller 7 is driven by a motor, not shown, so as to wind up the sheet 8 and pull it and the patient 1 across the mattress 9. The sheet unwinds at the head end of the bed from the roller 6 as it is wound up on the roller 7 at the foot end of the bed.

Figure 4:
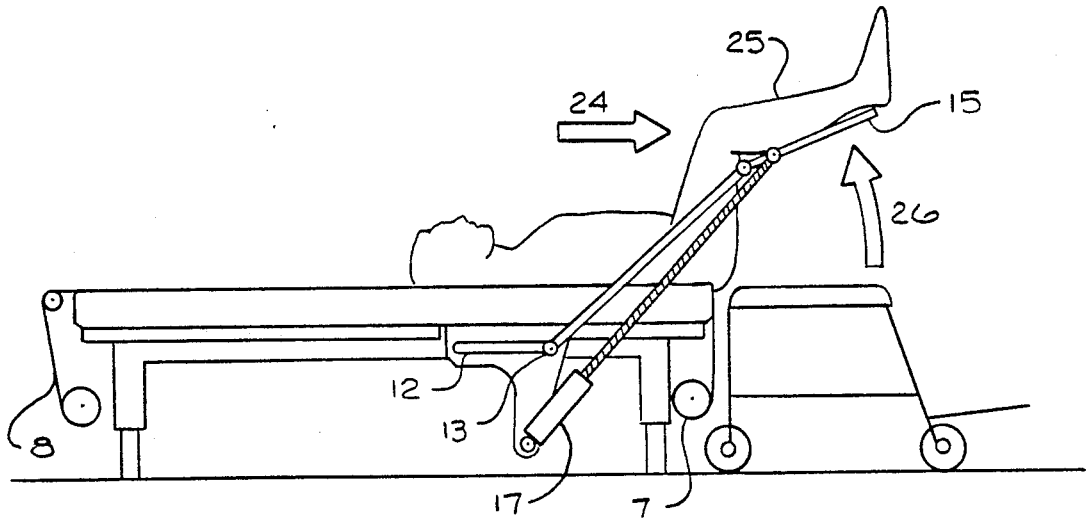

FIG. 4 shows the leg rest 15 being pushed forward and up in the direction of arrow 26 by the actuator 17 which forces pivot 13 to slide forward in the slot 12 so as to raise the patient's legs 25, as the sheet 8 moves the patient in the direction of arrow 24 to the edge of the mattress. The roller 7 then stops winding the transport sheet 8. The patient is now in a good position for cleaning by an attendant, as needed.

Figure 5:
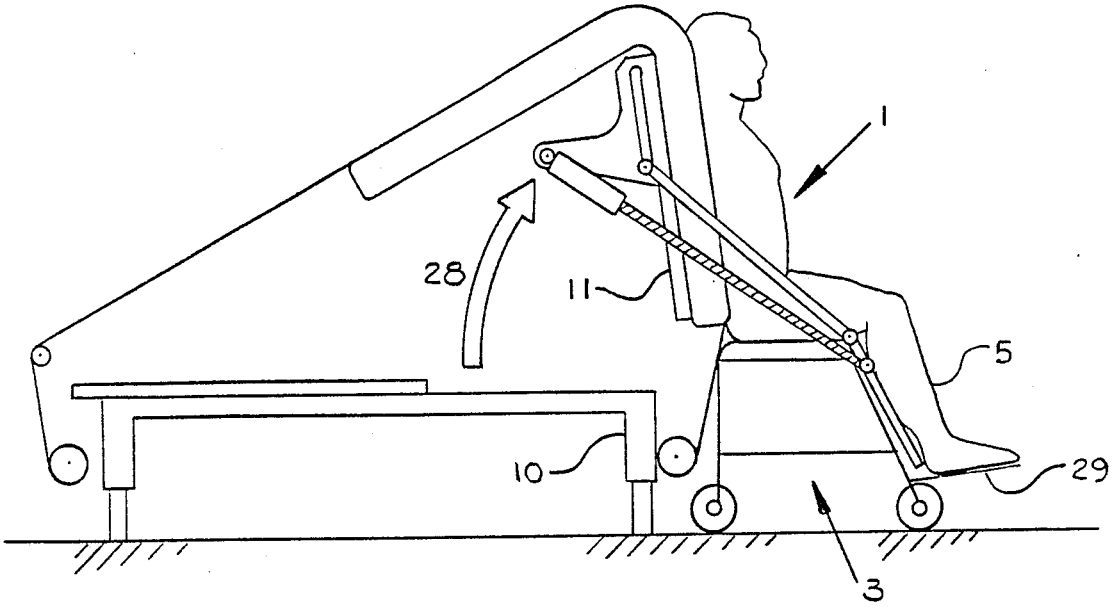

FIG. 5 shows schematically the patient 1 being lifted and rotated forward into a sitting position on the wheelchair 3 by the action of a mattress lift which rotates the mattress lift member 11 as shown by the arrow 28 about a pivot attached on the fixed frame 10. For reasons of clarity, the lift mechanism and pivot are not shown here.

The wheelchair back rest is then replaced in its normal position behind the patient's back and the leg rest cloth support, not visible here, is removed from behind the patient's legs 5, which are now supported on the foot rest 29. Removal of the leg rest cloth support frees the wheelchair so that it can be unlocked from the bed and moved away.

Figure 6:
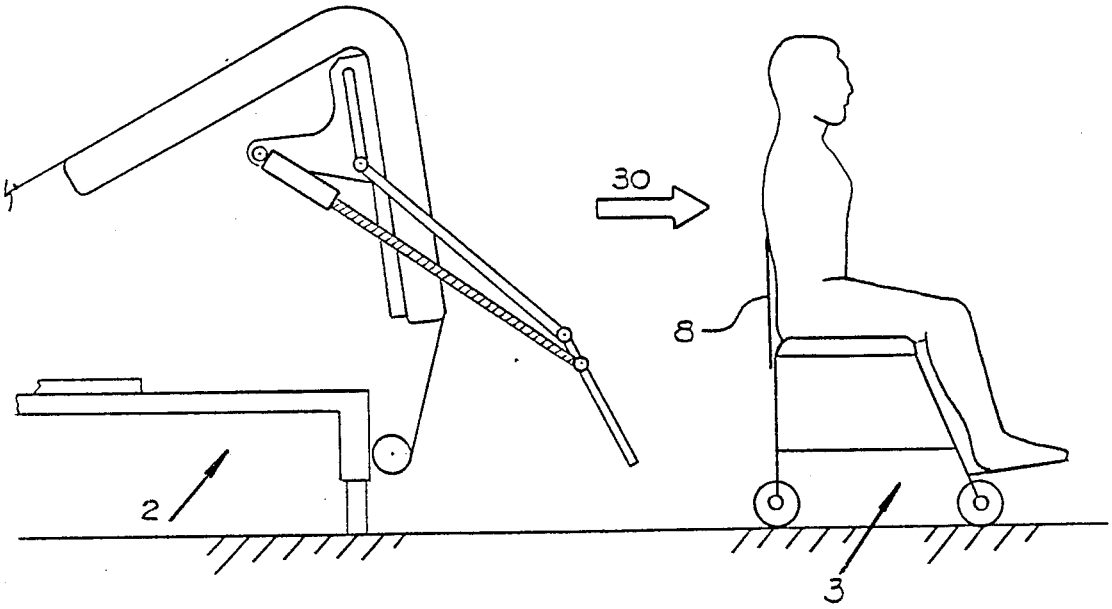

FIG. 6 shows the back rest 8 in place on the wheelchair, which has been moved away from the bed 2 in the direction of the arrow 30.

By reversing the steps shown in FIGS. 1 through 6, a patient can be transferred from a wheelchair to the bed 2.

Figure 7:
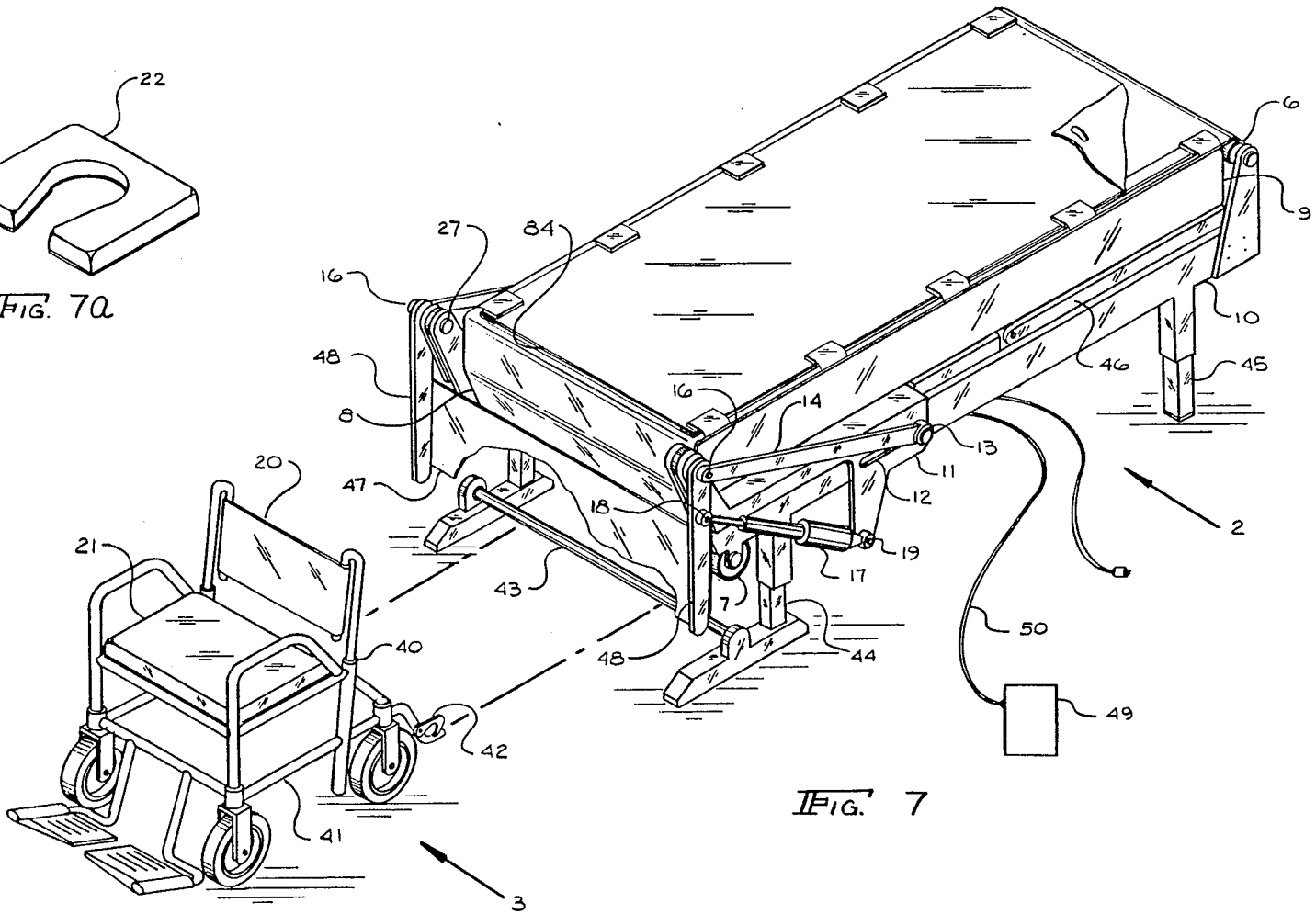
FIG. 7 is a perspective view of the equipment.
Figure 7A:
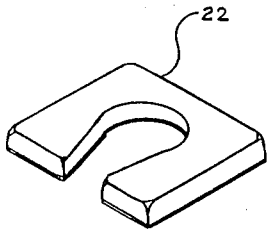
Figure 7B:
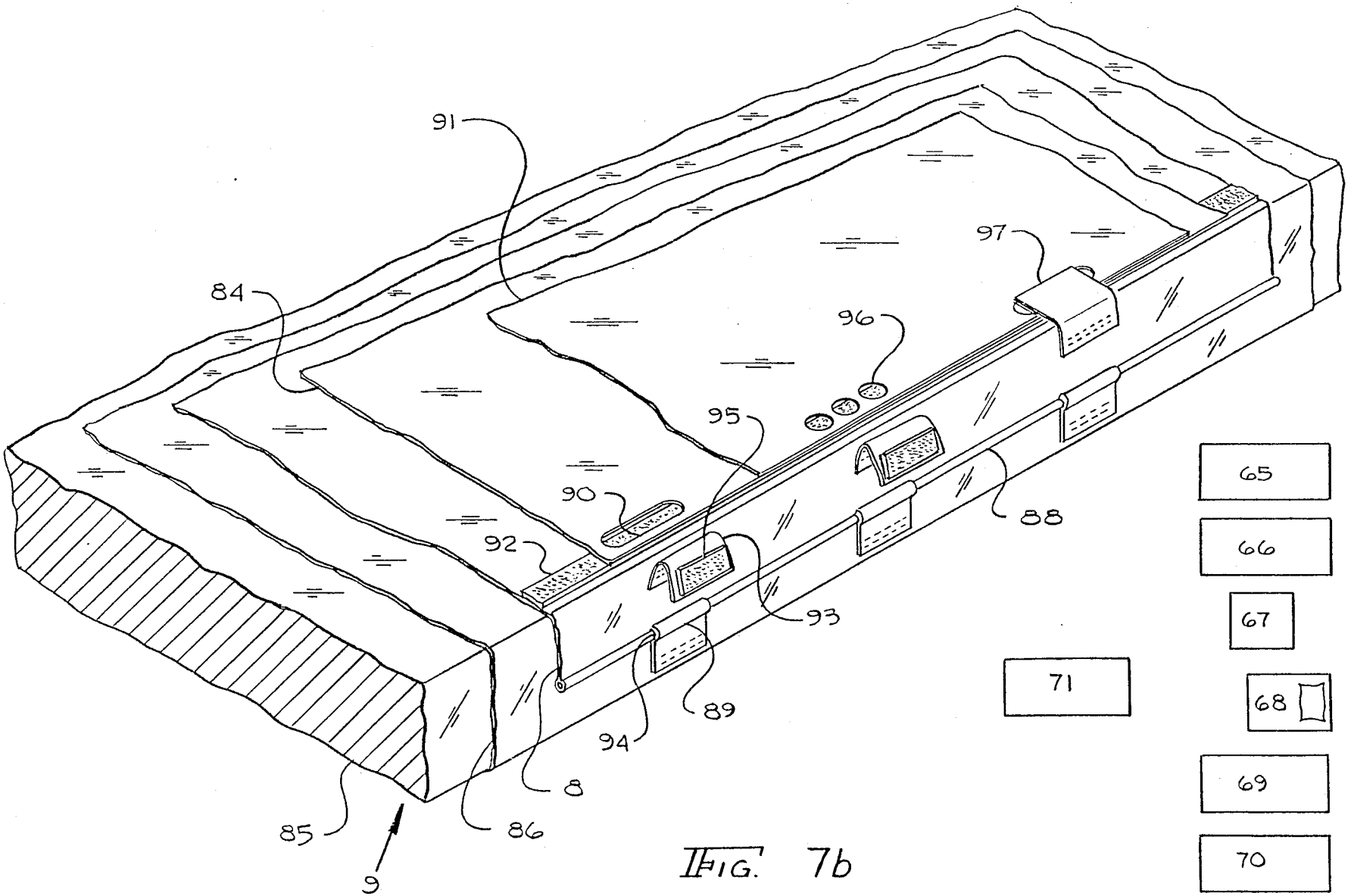

FIG. 7 shows the patient transfer arrangement with the wheelchair 3 separated from, and ready to be latched to, the bed 2.

The wheelchair 3 includes a seat 21, which is removable and replaceable by a commode seat 22, shown in FIG. *7a*. Such interchangeable seats are commonly available commercially in a commode-shower wheelchairs. The wheelchair back rest 20 is removable by lifting it out of sockets 40 in wheelchair frame 41, or by other means. When the wheelchair 3 is pushed up to the bed 2, latches 42, mounted to the frame 41, engage latch member 43 on the bed and hold the wheelchair 3 securely fastened thereto.

The bed 2 has a main frame 10 supported at one end of the bed by legs 44 which are connected to the latch member 43, resting on the floor. Legs 45 support the frame 10 at the other end of the bed. The bed frame 10 is raisable to different heights by cable or other means well known in the art and widely used in hospital type beds. A mattress 9 is supported by an articulated frame 46, which is mounted on the main frame 10. A transport sheet 8 extends across the mattress 9 and is partially wound up on rollers 6 and 7 at opposite ends of the bed. For transporting a patient across the bed, the transport sheet 8 is movable by winding the sheet on one roller, by an electric motor or other means not shown, while unwinding the sheet from the other roller. A bed sheet 84, on which a patient can sleep is attached on the transport sheet, by a method to be described subsequently.

A mattress lift member 11 is connected at both sides of the bed through pivots 27 to the main frame 10. The mattress lift member 11, which extends underneath the mattress 9, can be driven by means shown later to rotate about the pivots 27 so as to raise the mattress to the position shown in FIG. 5.

At each side of the mattress lift member 11 is a leg rest support 48, which is connected through a pivot 16 to a link 14. Each link 14 is pivotably connected to a sliding pivot 13 in a slot 12 in the lift member 11. At each side of the bed, an actuator 17 is connected, at one end, through pivot 19 to the mattress lift member 11 and, at the other end, through a pivot 18 to the leg rest support 48. Extending the actuator 17 raises the leg rest support, as shown in FIG. 2. A negator spring mounted on and hidden behind lift member 11 pushes the pivot 13 in the slot 12 toward the head end of the bed. A leg rest fabric 47, comprising a thin sheet of material, is fastened to and extends between the two leg rest supports 48 at each side of the bed. The leg rest fabric 47 is preferably a light weight flexible member, which may be cloth, and which is easily unfastened and removed from one or both leg rest supports 48 and from behind the patient's legs 25, after the patient is seated in the wheelchair 3, as shown in FIG. 5.

A control unit 49 is connected to the bed by a cable 50. The control unit 49 contains switches and logic circuitry, well known to those skilled in the art, for controlling the operation of the rollers 6 and 7 in moving the transport sheet 8; for controlling the actuator 34 to lift the mattress 9, as shown in FIG. 5; and for controlling the actuator 17 to lift the left rest support 48.

FIG. *7b* is a perspective view which shows in more detail the arrangement of the mattress and sheets. The mattress 9 comprises a mattress center 85, which may consist of polyurethane foam, and a mattress cover 86. The transport sheet 8 has thickened hems which pass through and are guided by grooves 94 in hem retainers 89 which are attached to the mattress cover 86. The hem retainers hold the transport sheet in place and prevent it from wrinkling. Bottom attachment strips 92 of touch-and-close, pull-and-release material, such as that available under the trade name Velcro, are fastened to the transport sheet 8, and mating top attachment strips 95 are fastened to attachment flaps 93 on the transport sheet. When the bed sheet 84 is properly positioned on the transport sheet, openings 90 in the bed sheets are located over the attachment strips on the carrier sheet so that the attachment flaps 93 can be pressed to engage and close the top and bottom attachment strips through the openings 90. A second sheet 91 with openings 96 can be placed over the bed sheet 84 with openings 90 and 96 overlapping, so that both sheets can be attached in the same manner, as shown by the attached flap 97. The second sheet can be a disposable sheet 65, a pad 66, a moisture absorbent pad 67 such as that commonly referred to as a "chuck", a sheet of cloth attached to a pillow 68, a bedsore protection pad 69, a cover 70, or a blanket 71.

FIG. 8 is a partial cross-sectional view of the bed 2 showing the mechanism for lifting the mattress 9. The cross-sectioned portion 9*a* of the mattress 9, which extends to the foot end of the bed, is supported by the mattress lift member 11 which is connected to the main frame 10 through pivots 27 at each side of the bed. A linear actuator 34, which may be located under the middle of the bed, is connected, at one end, through the pivot 38 to the main frame 10 and, at its other end, is rotatably connected to a rod 36. The rod 36 connects to ends of links 35 which are connected through pivots 37 to the main frame 10 near each side of the bed. Rollers 39 at the other ends of links 35 support the mattress lift member 11.

FIG. 9 shows that the mattress lift member 11 and the mattress 9 rotate about pivots 27 as they are lifted in the direction of arrow 28 by the links 35 pulled by the actuator 34 through the rod 36.

FIGS. 10 through 12 show a method of transferring a patient from the bed 2 to a standing position on the floor.

FIG. 10 is similar to FIG. 2, except that the wheelchair has been removed from the vicinity of the bed 2, and a foot support 75 is removably fastened to the leg rest 15. The patient is then ready to be moved forward by the transport sheet 8 in the direction of arrow 78.

FIG. 11 shows the patient moved forward with his feet against the foot support 75 and his legs 44 resting on the leg rest 15. Safety supports 76 and 77 are attached to secure the patient to the mattress 9 or the mattress lift member 11 and to the leg rest 15.

FIG. 12 shows that by rotating the mattress lift member 11 in the direction of arrow 28, the patient is rotated to a standing position on the floor. The safety supports 77 and 76 can now be released to free the patient for walking away from the bed.

FIGS. 13 through 16 shown an alternative method of moving a patient from a bed to a standing position on the floor. In this method a separate leg and foot support is used in place of a movable leg rest and actuator.

Figure 13:
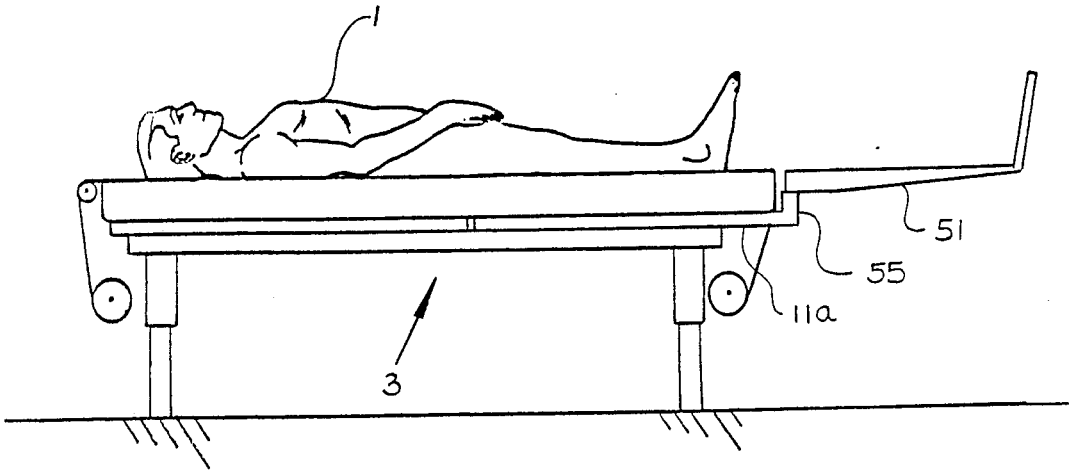
Figure 14:
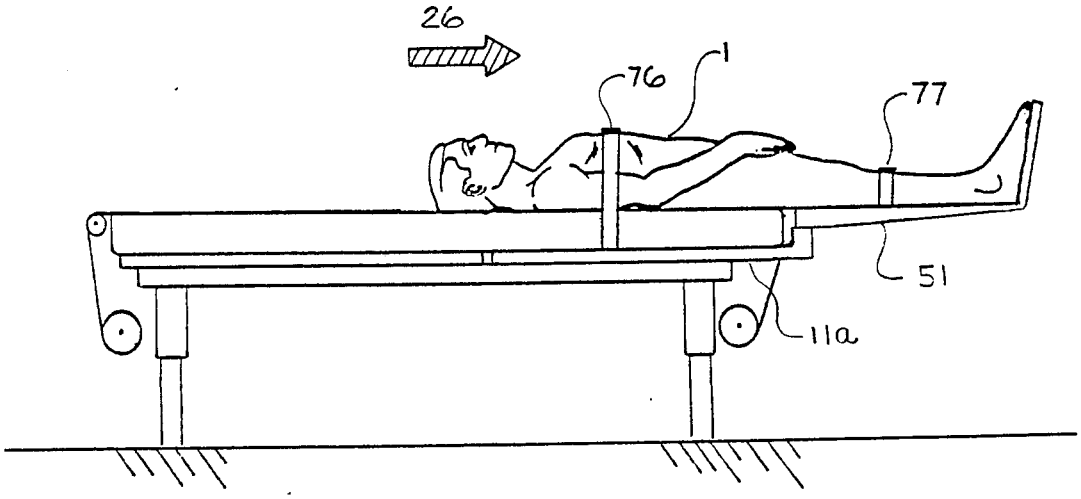

FIG. 13 shows a bed 3 which is similar to the bed 2 in FIG. 2, except that leg rest 15, link 14, and actuator 17 are omitted, and a foot and leg support 51 has been removably plugged into sockets 55 on, or fastened to, a mattress lift member 11*a*. FIG. 14 shows the patient 1 moved as shown by arrow 26 until his feet are fully on the leg and foot support 51. The patient is then fastened through safety supports 76 and 77 to the mattress lift member 11*a* and is lifted to a standing position in the same way as shown in FIGS. 10 through 12.

Figure 15:
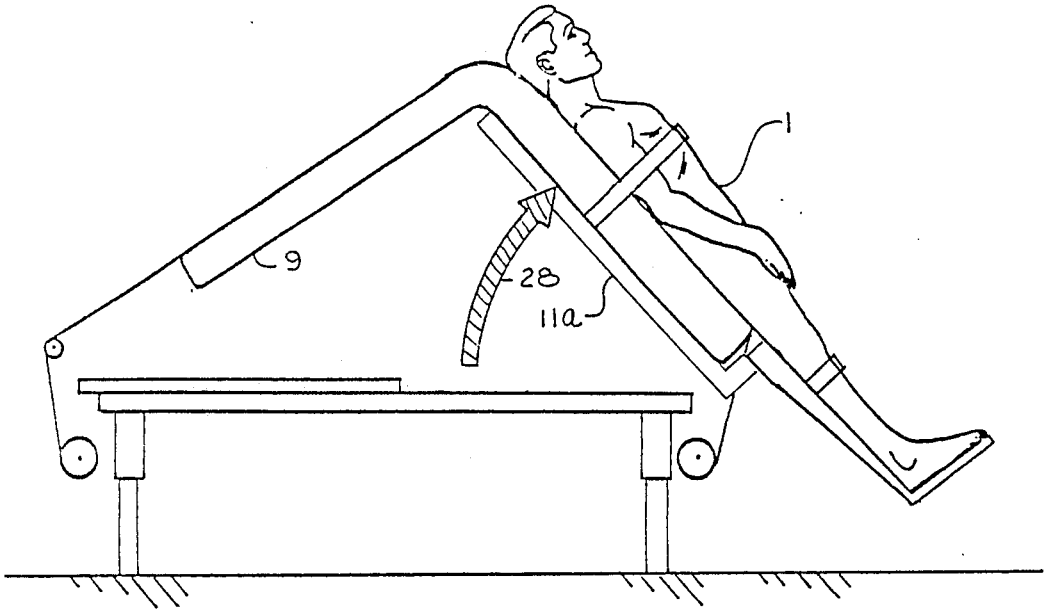

FIG. 15 shows the person 1 being raised by the mattress 9 and the mattress lift member 11*a* in the direction of the arrow 28.

Figure 16:
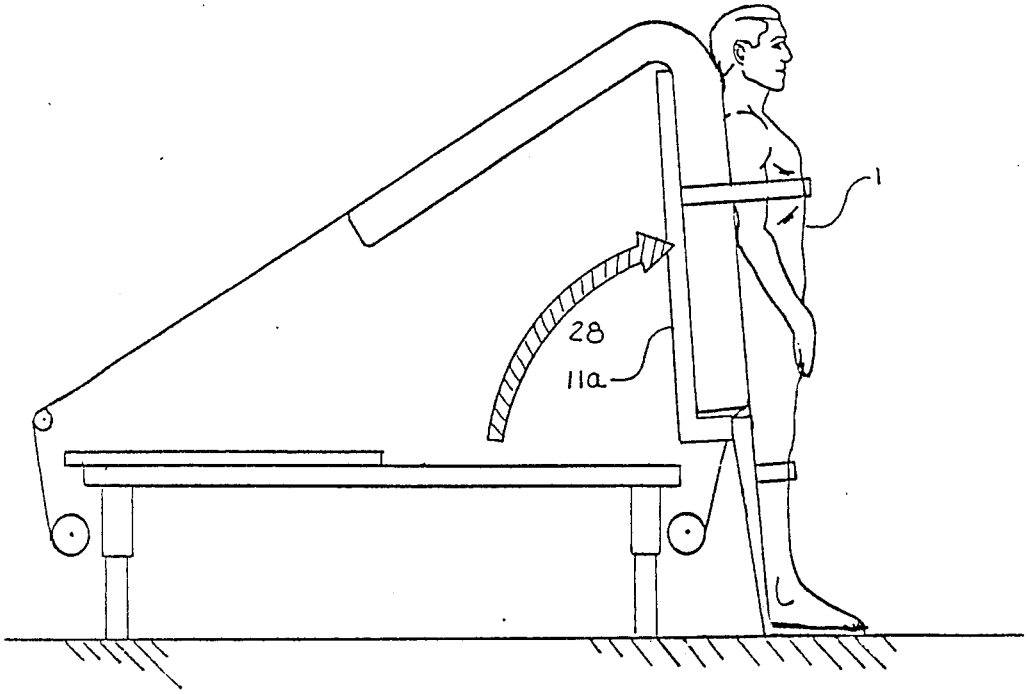

FIG. 16 shows the person 1 fully raised by the mattress lift member 11*a* to a standing position on the floor.

FIG. 17 shows the leg and foot support 51. It has a frame 53 including projections 54 which plug into sockets 55 on the mattress lift member 11*a*, as shown in FIG. 13. A leg rest surface 56 is made from a foam or other light-weight material with a low friction covering over which the patient's feet can slide. A foot support 57 is attached to the frame 53 for supporting the weight of a patient being rotated onto the floor.

FIGS. 18 through 20 show another alternative method of transferring a patient to a standing position on the floor.

FIG. 18 is similar to FIG. 13 except that the foot and leg support 51 has been removed. The person 1 is reclining on the bed 3.

FIG. 19 shows that the patient 1 has been moved by the transport sheet 8 to the edge of the mattress 9 with his legs 25 bent over the end of the mattress and his feet 31 resting on the floor. Knee supports 58 have then been moved into position to support his knees, as described subsequently.

FIG. 20 shows that raising the mattress 9, in the direction of arrow 28, as in FIG. 16, brings the patient to a standing position with his knees held in position by the knee and leg support 58.

FIG. 21 is a partial perspective view showing the arrangement of the knee and leg support 58, and portions of the mattress 9 with the transfer sheet 8 partially wound on the roller 7. The roller 7 is rotatably supported at each end by the foot transfer housing 59, one end of which is shown. The foot transfer housing is attached to, and supports, the main frame 11 of the bed, and the pivot bearing 60 which holds the knee and leg support 58. The foot transfer housing 59 rests on two bed legs 44, one of which is shown. One of the patient's legs 25 is shown supported by a movable leg support 58 which is rotatably held by a sleeve 80. As shown by arrow 81, the movable leg support can be rotated in the sleeve 80 between a stow position shown in FIG. 21*b* and a knee support position shown in FIGS. 21*a* and 21. The movable leg support 58 can also be rotated in the pivot bearing 60, as shown by the arrow 82, between the knee support position and an elevated position shown in FIG. 21*c*. For cleaning the patient, his legs can be placed on the elevated supports, which can be shaped to hold the legs securely. The movable leg support 58 and the pivot member 60 are each held in a selected position by a spring acting in conjunction with a detent, by a releasable latch or by some other such mechanism well known in the art. When a patient, who is being transferred to a standing position on the floor, reaches the position shown in FIG. 19, the movable leg support at each side of the bed is moved from a stowed position 58*a* to a transfer position 58. For cleaning the patient, the patient's legs can be conveniently placed on the movable leg support in an elevated position.

FIG. 22 shows an alternate leg brace arrangement for supporting a patient's legs for transfer to a standing position.

FIG. 22 is a perspective view of the bed 3 and shows the patient being supported by the mattress 9 elevated as in FIG. 20. A flexible leg brace 61, which may comprise a strip of cloth, is removably attached at each end to the foot transfer housing 59, so as to support the patient's legs as he is raised to a standing position.

FIGS. 23 and 24 show schematically an arrangement which can be incorporated in the bed 3 to prevent or reduce the probability of occurrence of decubitus ulcers (bedsores) in a patient. FIG. 23 shows a partial top view of the mattress 9 with a cover 86 and a transport sheet over it. Below the cover is a flexible air-tight tube 100 which is sealed at one end and inflated by an air pump 101. The flexible tube 100 is mounted on, or is part of, a flexible sheet of material 102.

FIG. 24 shows schematically a side cross sectional view through a section of the mattress 9 in FIG. 23 and with a patient thereon. The patient is reclining on the carrier sheet 8 which rests on the mattress 86 supported on the inflated tube 100 on flexible sheet 102 that is supported by the mattress 9. The carrier sheet 8 is moved as described previously in the direction of the arrows 104 and 105 to move the patient slowly back and forth across the mattress 9 and the tube 100. A programmer 106, electrically connected to the sheet drive motors, controls the sheet motion with control, timing, and logic circuitry well known to those skilled in the art. This motion causes variations in pressure on the parts of the patient's body which are resting on the bed, much as does alternating-pressure bedsore protection pads. In addition, the motion of the patient over the protruding tubes results in moving waves of pressure along the body which promotes the circulation of blood, as well as other fluids such as lymph, and thereby should greatly reduce the probability of decubitus ulcers, which are primarily caused by lack of blood circulation. Air is released to flatten the tube 100 and provide a smooth low friction surface when the patient is to be transferred off the bed.

FIG. 25 is a partial top view showing a variation in the arrangement of the tube 100 to provide lateral as well as longitudinal motion of the pressure areas on the patient's body as he is moved by the transport sheet. The inflatable tube 100 has branches which are oriented at various angles with respect to the bed such that longitudinal motion of the transport sheet and the patient thereon causes pressured zones of the inflated tube to effectively move both laterally and longitudinally at various relative rates across the patient's body. This motion should further stimulate circulation by pushing the blood through arteries and viens and other paths which extend across, as well as along, the patient's body. The angles of the tube branches with respect to the longitudinal axis of the bed may alternate between substantially plus and minus 30 degress, plus and minus 45 degrees, plus and minus 60 degrees or plus and minus 90 degrees as shown, or between any one, or any combination, of the above pairs of positive and negative angles.

FIG. 26 shows in a partial top view a particularly efficient and simple arrangement in which the tube 100 has branches with alternating segments **100*d* and 100*e*** at angles of plus 45 degrees and minus 45 degrees respectively, with respect to the longitudinal axis of the bed. These branches are connected to connecting branches in the vicinity of the head and foot ends of the mattress.

Alternatively, the design of the tube 100 may differ between different portions of the mattress so as to conform to different structures of the respective portions of a person's body. Design parameters which may differ include sizes, spacings, shapes and angles of the branches of the tube 100 or the inflation pressure.

FIG. 27 shows schematically an alternating pressure pad in which the tube 100 is divided into two or more separate tubes **100*a* and 100*b*** which are interlaced and are alternately inflated as in conventional commercial alternating pressure bedsore protection pads. The alternating pressure may be used alone or in combination with the sheet motion described previously.

Although FIGS. 23 through 25 show an arrangement with rollers at the head and foot ends of the bed, alternatively, the rollers could be located at opposite sides of a bed for bedsore protection purposes.

The arrangement of the bed shown in FIGS. 3 and 4 and described previously is useful for exercising the legs 25 of an immobile or paraplegic patient by cyclically moving them between a reclined position shown in FIG. 3 to an elevated position in FIG. 4. This type of motion is important in maintaining good circulation and health for such patients.

Substantially equivalent motion can be obtained by securing the sliding pivot 13 at the end of slot 12 as shown in FIG. 3, and by cyclically extending and retracting the actuator 17. It will be clear to those skilled in the art that a pin slidably mounted in the mattress lift member 11 and moved by a solenoid can be used to secure the pivot 13 from sliding. The control unit 49 shown in FIG. 7 can contain logic and timing circuitry for moving the actuator 17 cyclically for exercising the patient's legs 25.

I claim:

1. A bedsore protection arrangement comprising: a bed having a mattress, a cover on said mattress, and legs; transport means having rollers at opposite ends of the bed; a transport sheet on which a patient may lie and extending over said mattress between said rollers; roller drive means for winding said transport sheet onto a roller at one end of the bed and unwinding said transport sheet from a roller on the opposite end to pull said transport sheet and move said person across the mattress surface; motion control means connected to said roller drive means for slowly moving said transport sheet cyclically a distance toward one end and toward the other end; an adjustable surface member under said cover and having inflatable cavities forming raised ridges when inflated and having a substantially flat surface when deflated; an air pump and control means for inflating and deflating said cavities; said ridges having an alternating pattern of connected segments, at plus and minus a pattern angle with respect to a direction of motion of said sheet; and said distance being such that points on said transport sheet moving said distance pass over two said connected segments.

2. A bedsore protection arrangement as defined in claim 1 wherein said pattern angle is substantially 45 degrees.

3. A bedsore protection arrangement as defined in claim 1 wherein said transport sheet comprises said cover.

4. A patient transfer arrangement as defined in claim 1 wherein said adjustable surface member has an inflatable first cavity and a second inflatable cavity; inflation means for alternately and cyclically inflating one said cavity and deflating the other said cavity; said cavities being disposed in an interlocking pattern such that a patient is supportable by the inflated first cavity when said second cavity is deflated and is supportable by the inflated second cavity when said first cavity is deflated.

5. A patient transfer arrangement as defined in claim 1 wherein said ridges have an alternating pattern of connected segments at plus and minus multiple pattern angles with respect to a direction of motion of said sheet.

6. A bedsore protection arrangement comprising: a bed having a mattress and a cover on said mattress on which a person may lie; an adjustable surface member under said cover and having inflatable cavities forming raised edges when inflated and having a substantially flat surface when deflated; an air pump and control means for inflating and deflating said cavities; motor means to produce slow cylical linear motion between said cover and said adjustable surface member for causing pressure zones to move longitudinally under said person's body; said raised ridges having an alternating pattern of connected segments disposed at positive and negative angles with respect to a direction of said linear motion so as to product alternating lateral motion of the pressure zones in order to stimulate in both longitudinal and lateral directions.

7. A bedsore protection arrangement comprising: a bed having four sides, a mattress, a bed frame, and legs; transport means having rollers at opposite sides of the bed; a transport sheet on which a patient may lie and extending over said mattress between said rollers; roller drive means for winding said transport sheet onto a roller at one bed side and unwinding said transport sheet from a roller on the opposite bed side to pull said transport sheet and move said person across the mattress surface; an adjustable surface member extending over said mattress and under said transport sheet; said adjustable surface member having a smooth surface over which said person can be freely and comfortably moved over the mattress by the transport sheet; said adjustable surface member being convertible from having a smooth top surface to having a wavy top surface with high and low regions; and motion means for cyclically moving said transport sheet and said patient slowly over said wavy top surface so as to generate slowly moving pressure regions in the person's body for stimulating blood circulation and helping to prevent decubitus ulcers.

8. A bedsore protection arrangement as defined in claim 7 wherein said adjutable surface member has inflatable cavities forming raised regions when inflated and having a substantially flat surface when deflated; and air pump and control means for inflating and deflating said cavities.

9. A bedsore protection arrangement as defined in claim 8 wherein said inflatable cavities comprise tubes oriented at different angles with respect to the direction of motion of said transport sheet.

10. A bedsore protection arrangement as defined in claim 7 wherein said adjustable surface has a first inflatable cavity and a second inflatable cavity; inflating means for alternately and cyclically inflating one cavity and deflating the other cavity; said cavities being disposed in an interlocking pattern such that a patient is supportable by said first cavity with said second cavity deflated and is supportable by said second cavity when said first cavity is deflated.

11. A bedsore protection arrangement comprising: A bed having a mattress and a cover on said mattress on which a person may lie; an adjustable surface member under said cover and having inflatable cavities forming raised ridges when inflated and having a substantially flat surface when deflated; an air pump and control means for inflating and deflating said cavities; motor means to produce slow cyclical linear relative motion between said cover and said adjustable surface member for causing cyclical pressure waves to move under said person's body for stimulating blood circulation.

* * * * *